US010074348B2

(12) United States Patent
Seal

(10) Patent No.: US 10,074,348 B2
(45) Date of Patent: Sep. 11, 2018

(54) LAMINATE FACED HONEYCOMB BRACING STRUCTURE FOR STRINGED INSTRUMENT

(71) Applicant: MCP IP, LLC, Sparta, WI (US)

(72) Inventor: Ellis C. Seal, Bay Saint Louis, MS (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 14/055,534

(22) Filed: Oct. 16, 2013

(65) Prior Publication Data

US 2015/0101473 A1 Apr. 16, 2015

(51) Int. Cl.
*G10D 3/00* (2006.01)
*G10D 3/02* (2006.01)
*G10D 1/08* (2006.01)

(52) U.S. Cl.
CPC ..... *G10D 3/02* (2013.01); *G10D 1/08* (2013.01)

(58) Field of Classification Search
USPC ..... 84/291
See application file for complete search history.

(56) References Cited

U.S. PATENT DOCUMENTS 3,477,330 A * 11/1969 Bert ..... G10C 3/06 84/193
3,478,634 A 11/1969 Haerich
3,691,891 A * 9/1972 Delu ..... G10D 3/02 84/275
3,699,836 A * 10/1972 Glasser ..... G10D 1/005 84/275
4,348,933 A * 9/1982 Kaman ..... G10C 3/06 84/193
4,353,862 A 10/1982 Kaman, II
4,364,990 A 12/1982 Haines
4,429,608 A * 2/1984 Kaman ..... G10D 3/02 84/291
4,836,076 A 6/1989 Bernier
4,969,381 A 11/1990 Decker, Jr. et al.
5,333,527 A * 8/1994 Janes ..... B29C 70/083 156/245
5,396,823 A 3/1995 Hoshino
5,406,874 A 4/1995 Witchel
5,900,561 A 5/1999 Wechter
5,952,592 A 9/1999 Teel
6,051,096 A 4/2000 Nagle et al.
6,087,568 A 7/2000 Seal
6,233,825 B1 * 5/2001 Degroot ..... G10D 1/005 29/896.22

(Continued)

OTHER PUBLICATIONS

Search Report of International Application No. PCT/US14/60913 dated Jan. 29, 2015.

(Continued)

*Primary Examiner* — Christopher Uhlir

(57) ABSTRACT

A soundboard for a musical instrument is disclosed the soundboard having at least one layer of material. In some embodiments the material comprising carbon fiber, fibrous laminate material, resin or a plastic matrix and combinations thereof. At least one bracing structure is engaged to the at least one layer of material. The at least one bracing structure comprising at least one layer of honeycomb or shaped core and at least one sheet of material bonded to the honeycomb or shaped core.

17 Claims, 5 Drawing Sheets

(56) References Cited

U.S. PATENT DOCUMENTS

| | | | | |
|---|---|---|---|---|
| 6,294,718 | B1 | 9/2001 | Saunders, Jr. et al. | |
| 6,332,029 | B1 | 12/2001 | Azima et al. | |
| 6,333,454 | B1 | 12/2001 | Griffiths | |
| 6,664,452 | B1 | 12/2003 | Teel | |
| 6,943,283 | B2 * | 9/2005 | McPherson | G10D 3/02 84/290 |
| 7,208,665 | B2 | 4/2007 | Schleske | |
| 7,268,280 | B2 | 9/2007 | McPherson | |
| 7,342,161 | B1 | 3/2008 | Fox | |
| 7,507,885 | B2 | 3/2009 | Coke | |
| 7,612,271 | B1 * | 11/2009 | Davis | G10D 3/02 84/267 |
| 7,687,696 | B2 * | 3/2010 | Fox | G10D 3/06 84/267 |
| 7,763,784 | B2 * | 7/2010 | Luttwak | G10D 1/00 84/267 |
| 7,786,361 | B1 * | 8/2010 | Foltz | G10D 1/005 84/267 |
| 7,790,970 | B2 | 9/2010 | McPherson | |
| 7,795,513 | B2 | 9/2010 | Luttwak | |
| 8,035,025 | B1 | 10/2011 | Donnell | |
| 8,163,379 | B2 | 4/2012 | Doecker et al. | |
| 8,450,587 | B2 * | 5/2013 | McPherson | G10D 3/02 84/267 |
| 2006/0174753 | A1 | 8/2006 | Aisenbrey | |
| 2010/0210745 | A1 | 8/2010 | McDaniel et al. | |
| 2011/0162506 | A1 | 7/2011 | Yokoyama | |
| 2011/0174133 | A1 | 7/2011 | Unkert et al. | |
| 2012/0090449 | A1 * | 4/2012 | Lee | G10H 3/143 84/731 |
| 2014/0144306 | A1 * | 5/2014 | Seal | G10D 1/005 84/291 |
| 2015/0068383 | A1 * | 3/2015 | Shopa | G10C 3/04 84/184 |

OTHER PUBLICATIONS

Written Opinion of International Application No. PCT/US14/60913 dated Jan. 29, 2015.

* cited by examiner

LAMINATE FACED HONEYCOMB BRACING STRUCTURE FOR STRINGED INSTRUMENT

FIELD OF THE INVENTION

The present invention relates to an acoustic guitar or other stringed musical instruments having a sound box, and more particularly, the present invention relates to a unique bracing structure for the soundboard of the musical instrument comprising a structure which may include bracing arranged in a traditional or non-traditional pattern, and where the bracing may be formed of carbon or other suitable fiber laminates with a honeycomb or other shaped interior or core, to improve structural integrity of the soundboard while simultaneously enhancing sound quality and performance for the instrument.

BACKGROUND OF THE INVENTION

Carbon fiber has been used in various portions of stringed instruments since the 1970s. Carbon fiber laminates are generally stiff and light; however they do not generally have the acoustic characteristics desired by those who are used to the sound of wood. The natural acoustic characteristics of carbon laminates tend to sound metallic and lack the warmth of wood. In addition, solid carbon fiber laminates generally have a higher density as compared to wood, and for a given weight, have significantly lower bending stiffness. Therefore, designing carbon fiber laminates with an acoustic response, tone, and feel of wood instruments is challenging.

Many different variations of wood and carbon fiber bracing have been attempted to provide an acceptable level of performance with respect to vibration, structural integrity, acoustic response, tone, and feel of the stringed instrument. In addition, many different types of soundboards have been attempted which have been formed of solid carbon, or by bonding carbon sheets together or to a foam core or a wood core. These types of soundboards in many instances have resulted in a soundboard which is over damped, and in instances where the face sheets of carbon laminate of the soundboard are too thin, then the soundboard is prone to damage upon exposure to minor impacts.

Bracing for guitars have also incorporated the use of foam or syntactic foam cores. Syntactic foam cores are generally formed by a process where layers of a mesh are filled with microballoons which are disposed or laid into a laminate. The mesh is filled with resin during the soundboard fabrication process creating an internal core. This type of bracing tends to be too highly damped and/or heavy, especially with respect to syntactic foam cores.

A typical acoustic guitar has a hollow body or sound box connected to a neck. The hollow body has a soundboard with a sound hole, a back or bottom board spaced from the soundboard, and a shaped side wall which connects between the soundboard and backboard. These components in the past have been typically constructed of choice pieces of wood in order to produce instruments of superior quality.

An acoustic guitar has a series of strings strung at substantial tension from a bridge on the soundboard, across the soundboard proximate to a sound hole, and along the neck. The string tension creates forces which act on the soundboard and which, over time, may cause bending, cracking or other damage to the soundboard. The damage can result in structural failure and altered intonation of the acoustic guitar. As such, the guitar, notably the sound box, must be constructed in a relatively strong and stable manner, without making it to heavy, or limiting its response.

In high quality acoustic guitars, the soundboard must be capable of vibration to provide superior acoustic performance while being rigid so that it withstands the forces created by the tensioned strings. These requirements are at cross-purposes, and have been very difficult to achieve, particularly when the soundboard is constructed from a material other than choice wooden materials. The soundboard is in close union with the remaining pieces of the sound box.

Acoustic guitars are constructed so as to amplify the sound wave produced by the vibration of the strings, via a resonance body having a soundboard. The sound wave created by the vibrating strings is introduced into the resonance body through the bridge provided on the soundboard. Inside the resonance body, the sound wave is resounded and amplified within the resonance body. If the resonance body is not constructed correctly, the sound may be emitted in a muffled or dampened manner.

Prior art designs have also attempted to utilize a number of different types of materials for braces or to form the soundboard or other portions of the sound box. Examples of these prior art devices may be found in U.S. Pat. Nos. 6,943,283; 4,353,862; 7,612,271; 5,396,823; 4,429,608; 4,836,076; 5,333,527; 6,333,454; 7,208,665; 5,406,874; 5,952,592; 4,969,381; 6,664,452; 7,268,280; and 7,790,970 the entire contents all of which being incorporated herein by reference in their entireties.

The present invention provides for a uniformly strong soundboard which in conjunction with the sound box delivers clean, brilliant sound. The construction of the soundboard provides for easier and more economical manufacture when state of the art equipment is used.

All U.S. patents and applications all other published documents mentioned anywhere in this application are incorporated herein by reference in their entireties.

Without limiting the scope of the invention in any way, the invention is briefly summarized in some of its aspects below.

The art referred to and/or described above is not intended to constitute an admission that any patent, publication or other information referred to herein is "prior art" with respect to this invention.

BRIEF SUMMARY OF THE INVENTION

In accordance with the invention, a laminate faced honeycomb or other shaped bracing structure is provided for use with a soundboard. The laminate faced honeycomb or other shaped bracing structure comprises one or more layers of carbon fiber or other fibrous laminates and one or more layers of a honeycomb or shaped core disposed between the one or more layers of carbon fiber or other fibrous laminates. In at least one embodiment the laminate faced honeycomb or other shaped bracing structure comprises a lower layer member engaged or bonded to a soundboard and at least one honeycomb or shaped core engaged or integral with the lower layer member. An intermediate bracing layer member or upper bracing layer member may be disposed on the lower layer member to provide a desired level of structural integrity to the soundboard as well as providing a desired amount of resonance and acoustic properties for a stringed instrument.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying description, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
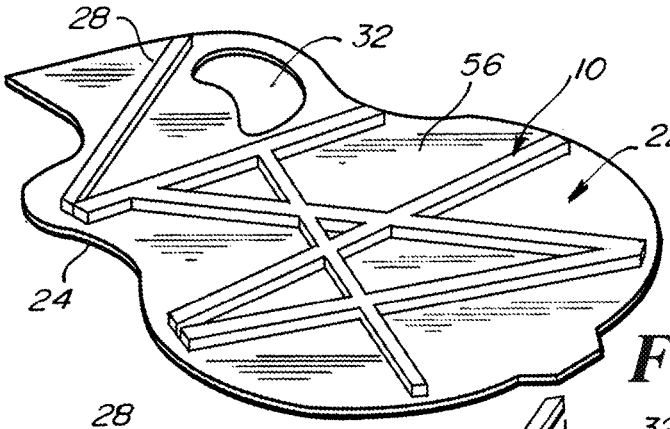
FIG. 1 is an isometric view of one embodiment of a soundboard and laminate faced honeycomb or other shaped bracing structure.

While this invention may be embodied in many different forms, there are shown in the drawings and described in detail herein specific embodiments of the invention. The present disclosure is an exemplification of the principles of the invention and is not intended to limit the invention to the particular embodiments illustrated. For the purposes of this disclosure, unless otherwise indicated, identical reference numerals used in different figures refer to the same component.

In some embodiments, the soundboard 22 may be formed of 1 to 5 or more layers of composite materials or laminates which in some embodiments may be formed of carbon fiber, fibrous laminates, resin, or plastic matrix or combinations thereof. In other embodiments, individual layers of material 24 forming the soundboard 22 may be constructed of the same materials. In other embodiments, the individual layers of material 24 may be formed of different materials. In further embodiments, the individual layers of material 24 may alternate in any regular or irregular sequence for combination together to provide a desired amount of vibration and tonal characteristics or performance for a stringed instrument. In some embodiments, the laminate faced honeycomb or other shaped bracing structures and/or the individual layers of material 24 for the soundboard 22 may be formed of Nomex fiber in a resin mix; glass fiber in a resin mix; paper in a resin mix; carbon fiber in a resin mix; metals such as aluminum; polymers such as polypropylene; polyvinyl chloride; ABS; polycarbonate; carbon faced foam; carbon graphite; carbon graphite fabric; fiber cloth matrix; fiber cloth and resin matrix; plastics; composite materials; foam; wood; fiberglass; glass foam; beryllium; a fiber glass epoxy blend, other fibrous laminates incorporating glass, silicon carbide, ceramic fibers, and/or other suitable materials and combinations of the materials as identified above. It should be noted that the materials identified herein are representative, and are not intended to be limiting of the types of materials which may be utilized for either the soundboard 22 or the laminate faced honeycomb or other shaped bracing structure 10 as described herein.

While carbon fiber is viewed as the fiber of choice for the preferred embodiment for the laminates used in the laminate faced honeycomb or other shaped bracing structure, it is anticipated that other fibers may provide acceptable performance. Alternate fibers may include but are not limited to fiberglass, silicon carbide, Nextel (3M trademark) or other ceramic fiber, basalt, cotton, jute, or bamboo, etc.

In at least one embodiment, a honeycomb or shaped core 26 is disposed between the individual layers 24. In some embodiments, more than one individual layer 24 will be disposed above or below the honeycomb or shaped core 26, or both above and below the honeycomb or shaped core 26, to form the soundboard 22. In at least one alternative embodiment, the soundboard 22 will include two or more honeycomb or shaped cores 26. In other embodiments, the soundboard 22 will not include any honeycomb or shaped cores 26. In at least one embodiment, each honeycomb or shaped core 26 may have a standardized thickness/height dimension. In other embodiments the thickness/height dimension for each layer of honeycomb or shaped core 26 and/or soundboard 22 may vary depending upon desired structural and vibrational characteristics and/or tonal/acoustic qualities. In at least one embodiment, at least one layer of carbon fiber or fibrous laminate material is disposed above, below, or both above and below, each layer of honeycomb or shaped core 26. In other embodiments, a honeycomb or shaped core 26 may be utilized without an adjacent layer of carbon fiber, fibrous laminate material or carbon fiber laminate. In at least one embodiment, a laminate of carbon fiber or other material may be bonded to both a honeycomb or shaped core 26 and to the face of a soundboard 22.

In some embodiments, the honeycomb or shaped core 26 may be formed of composite materials, which in some embodiments may be formed of carbon fibers, fibrous laminates, resin, plastic matrix, Nomex fiber in a resin matrix, glass fiber in a resin matrix, paper and resin matrix, carbon fiber and a resin matrix, metals such as aluminum, polymers such as polypropylene, polyvinyl chloride, or other suitable materials or combinations of one or more of the materials as identified herein.

In some embodiments, the honeycomb or shaped core 26 is formed of either open cell or closed cell materials.

In the embodiments described herein, the soundboard 22, individual layers 24, and/or the honeycomb or shaped core 26, if utilized, are constructed and arranged to enhance acoustic qualities while simultaneously providing structural integrity for a soundboard 22 and stringed musical instrument. In at least one embodiment, the selection of materials for the soundboard 24; the individual layers 24; the number of individual layers 24; and/or the dimensions and/or the materials for the honeycomb or shaped core 26, provide adjustable or variable stiffness to the entire soundboard 22. In other embodiments, the combination and arrangement of individual layers 24, the number of individual layers 24, the material selected for the individual layers 24, and/or the dimensions and/or materials for the honeycomb or shaped core 26 may be configured to provide adjustable or variable stiffness to desired portions or sections of the soundboard 22.

In some embodiments, the soundboard 22 may include laminate faced honeycomb or other shaped bracing 10. In at least one embodiment, the laminate faced honeycomb or other shaped bracing 10 will have a top layer 12 and a bottom layer 14 of composite or laminate materials which in some embodiments may be formed of carbon fiber; fibrous laminates; resin; plastic matrix; Nomex fiber in a resin mix; glass fiber in a resin mix; paper in a resin mix; carbon fiber in a resin mix; metals such as aluminum; polymers such as polypropylene; polyvinyl chloride; ABS; polycarbonate; carbon faced foam; carbon graphite; carbon graphite fabric; fiber cloth matrix; fiber cloth and resin matrix; carbon fibers; plastics; composite materials; foam; wood; fiberglass; glass foam; beryllium; a fiber glass epoxy blend; other fibrous laminates incorporating glass, silicon carbide, ceramic fibers, and/or other suitable materials and combinations of the materials as identified herein. In at least one embodiment, the laminate faced honeycomb or other shaped bracing 10, the top layer 12 and the bottom layer 14 may be formed of the same material. In other embodiments, the laminate faced honeycomb or other shaped bracing 10, the top layer 12, and the bottom layer 14 may be formed of different materials with respect to each other. In other embodiments, each of the elements of the laminate faced honeycomb or other shaped bracing 10, the top layer 12, and/or the bottom layer 14 may be formed of a combination of materials which are different from each other.

In at least one alternative embodiment the laminate faced honeycomb or other shaped bracing 10 may also include side layers 18 disposed on opposite sides of a honeycomb or other shaped core 16. In some embodiments, the side layers 18 and honeycomb or shaped core 16 are formed of the same material as the top layer 12 and bottom layer 14. In other embodiments, the side layers 18 may be formed of different materials with respect to the top layer 12, bottom layer 14, and honeycomb or shaped core 16.

In at least one alternative embodiment, the laminate faced honeycomb or other shaped bracing 10 may include one or more top layers 12, bottom layers 14, and/or side layers 18 as disposed adjacent to a honeycomb or shaped core 16. In at least one embodiment, each of the top layers 12, bottom layers 14, and side layers 18 may be formed of at least one layer of material as identified herein, including carbon composite materials.

In at least one embodiment, the laminate faced honeycomb or other shaped bracing 10 may be formed of one or more layers of honeycomb or shaped core 16 which are stacked with respect to each other, where an intermediate layer 20 is disposed between layers of honeycomb or shaped core 16. Each intermediate layer 20 may also be formed of one or more of the materials identified herein. In at least one alternative embodiment no intermediate layer 20 is disposed between adjacent layers of honeycomb or shaped core 16. In alternative embodiments, more than one intermediate layer 20 may be disposed between adjacent layers of honeycomb or shaped core 16.

In some embodiments, more than one bottom layer 14 may be disposed between the laminate faced honeycomb or other shaped bracing 10 and the soundboard 22. In alternative embodiments, the bottom layer 14 may be disposed immediately adjacent the soundboard 22 and in further embodiments, the honeycomb or shaped core 16 may be disposed directly adjacent to the soundboard 22 without the use of a bottom layer 14.

In some embodiments, the honeycomb or shaped core 16 is formed into either an open cell or closed cell configuration. In alternative embodiments, the cells of the honeycomb or shaped core 16 are disposed vertically with the open interiors aligned along an axis which is substantially normal to a plane established by the soundboard 22. In alternative embodiments, the cells of honeycomb or shaped core 16 are disposed horizontally with the open interiors aligned along an axis which is substantially parallel to a plane established by the soundboard 22.

In at least one embodiment, the laminate faced honeycomb or other shaped bracing 10 provides support to enhance the structural integrity to the soundboard 22 of a stringed instrument. Simultaneously, the carbon fiber honeycomb or other shaped bracing 10 may be used to regulate vibration of the soundboard 22 to enhance acoustic properties and resonance desired for the stringed instrument.

In at least one embodiment, the laminate faced honeycomb or other shaped bracing 10 may be arranged into a traditional bracing pattern including straight sections 28 which are disposed about the interior of a soundboard 22. In some embodiments, the straight sections 28 may cross one another at perpendicular or non-perpendicular angles to enhance the structural integrity of various locations of the soundboard 22.

In at least one embodiment, the laminate faced honeycomb or other shaped bracing 10 may be formed into a lower layer member 50 having an elongate multi-pointed concave polygon shape 30. In at least one embodiment, the shape 30 has a substantially rectangular section 34 which is disposed on the soundboard 22 adjacent to a location receiving the neck of a stringed instrument. In some embodiments a first point portion 36 may extend outwardly from a central section 42 of the shape 30 towards the periphery or perimeter 44 of the soundboard 22. In at least one embodiment, the sound hole 32 is disposed proximate to the first point portion 36 in a resonance area 56. In at least one embodiment, the first point portion 36 is substantially normal to a medial line 38 which bisects the shape 30 vertically, along the longitudinal axis of the stringed instrument, into mirror image portions. It should be noted that in certain embodiments that the shape 30 and the lower layer member 50 are not required to be symmetrical about the bisecting medial line 38. For convenience only one side of shape 30 is described because the shape 30, in at least one embodiment is symmetrical and a mirror image of the opposite side about medical line 38.

In at least one embodiment, a second point portion 40 of shape 30 is located below the first point portion 36 and is disposed at either an acute or obtuse angle relative to the bisecting medial line 38. The second portion 40 extends outwardly from the central section 42 of the shape 30 towards the periphery 44 of the soundboard 22. In at least one embodiment, the second point portion 40 is disposed and acute angle relative to the bisecting medial line 38 towards the top or neck portion of the soundboard 22.

In at least one embodiment, the lower layer member 50 includes a third point portion 46 which is located below the second point portion 40. The third point portion 46 in certain embodiments is disposed in a substantially normal direction relative to the bisecting medial line 38 and extends outwardly from the central section 42 of shape 30 towards the periphery 44 of the soundboard 22.

In at least one embodiment, the lower layer member 50 includes a fourth point portion 48 which is located below the third point portion 40. The fourth point portion 48 in certain embodiments is disposed at either an acute or obtuse angle relative to the bisecting medial line 38, which is approximately 90° offset relative to the angle of the second point portion 40. In certain embodiments, the fourth point portion 48 extends outwardly from the central section 42 of shape 30 towards the periphery 44 of the soundboard 22.

In at least one embodiment, the lower layer member 50 includes a fifth point portion 52 which is located below the fourth point portion 48 proximate to the bottom of the soundboard 22. In certain embodiments, the bisecting medial line 38 traverses and bisects the fifth point portion 52 into mirror image halves. In certain embodiments, the fifth point portion 52 extends outwardly from the central section 42 of shape 30 towards the periphery 44 of the soundboard 22.

Figure 13:
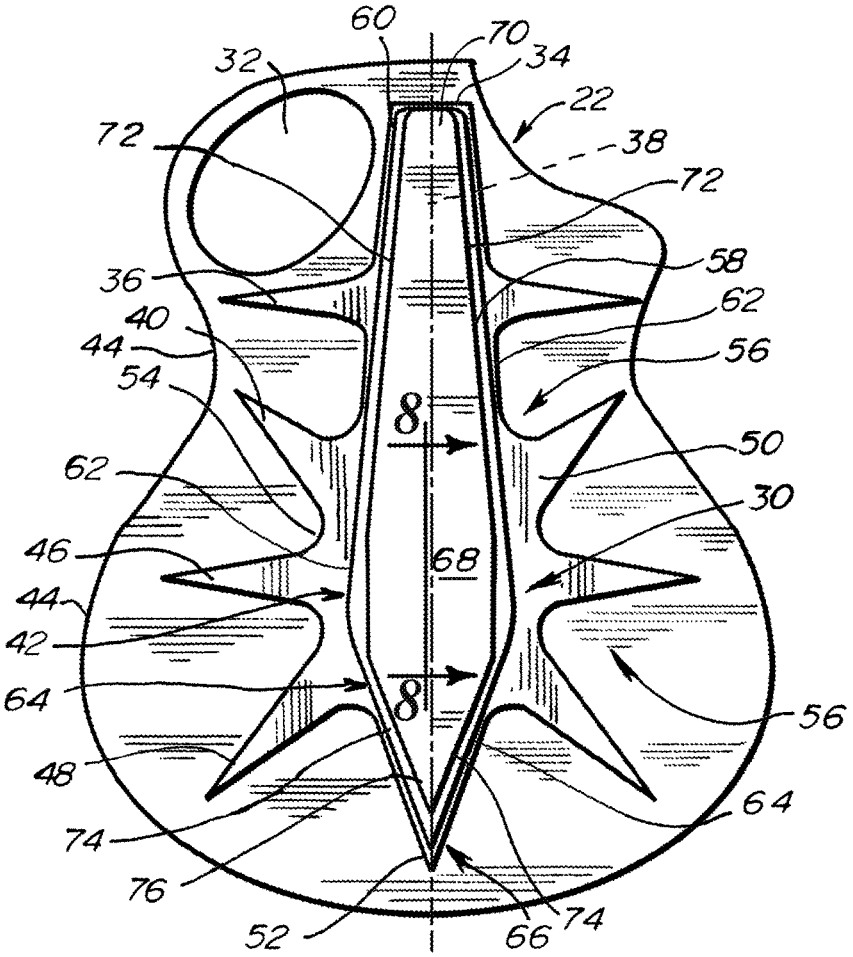
FIG. 13 is a top view of one embodiment of a soundboard having a laminate faced honeycomb or other shaped bracing structure according to the invention.

In at least one embodiment, a transition 54 is located between each respective point portion 36, 40, 46, 48 and 52. As depicted in FIG. 13 the transition 54 may be curved, or as in the case between the first point portion 36 and the second point portion 40, is elongated having a substantially linear portion. In some embodiments, the point portions 36, 40, 46, 48 and 52 define resonance areas 56 on the soundboard 22 between adjacent point portions. As depicted in FIG. 13, each point portion 36, 40, 46, 48 and 52 may include substantially linear sides which terminate in a point adjacent to the periphery 44 of the soundboard 22.

In some embodiments, the lower layer member 50 may be formed of any number of individual layers 24, top layers 12, bottom layers 14, intermediate layers 20, and honeycomb or shaped cores 16 as earlier described. In some embodiments, the lower layer member 50 is formed of the same materials as earlier described with respect to the laminate faced honeycomb or other shaped bracing 10 or soundboard 22. It should be noted that portions of the lower layer member 50 may be formed of different materials with respect to other portions of the lower layer member 50, in order to enhance structural integrity of the soundboard 22, or to provide desired acoustical or resonance properties for the soundboard 22.

In some embodiments, the lower layer member 50 may include more or less than five pointed portions. In some embodiments, the lower layer member 50 is not symmetric about the bisecting medial line 38 and may be any shape as desired. In other embodiments, the tips of the point portions 36, 40, 46, 48 and 52 extend outwardly from the central section 42 of the lower layer member 50 an equal distance relative to the periphery 44 of the soundboard 22. In other embodiments, the ends of the point portions 36, 40, 46, 48 and 52 may extend outwardly from the central section 42 an unequal distance relative to the periphery 44, in order to provide a desired level of structural integrity to selected portions of soundboard 22, or to adjust the acoustical or resonance properties of the soundboard 22.

In at least one embodiment, the lower layer member 50 includes at least one layer of honeycomb or shaped core 16 which in some embodiments is faced on the top and bottom by at least one layer of carbon fiber, fibrous laminate, or other materials as identified herein. In some embodiments, the sides of the honeycomb or shaped core 16 are open to provide a desired flex, vibration, acoustics and/or resonance for the soundboard 22. In other embodiments, the sides of the honeycomb or shaped core 16 may be closed or covered with one or more layers of carbon fiber, fibrous laminates, or other material as described herein to provide a desired flex, vibration, acoustics and/or resonance for the soundboard 22.

In at least one embodiment, an intermediate bracing layer member 58 is stacked centrally on the top of the lower layer member 50. The intermediate bracing layer member 58 in some embodiments is formed of the same, or combinations of materials, as previously identified herein. In certain embodiments, the intermediate bracing layer member 58 includes a top layer 12, bottom layer 14, honeycomb or shaped core 16, and/or side layers 18, or combinations thereof. In some embodiments, the intermediate bracing layer member 58, like the laminate faced honeycomb or other shaped bracing 10, lower layer member 50, and soundboard 22 may include one or more layers of honeycomb or shaped core 16 and one or more layers of carbon fiber, fibrous laminate, or other material as identified herein, below, above, or to the sides of each layer of honeycomb or shaped core 16. The features and elements as earlier described relative to the laminate faced honeycomb or other shaped bracing 10, soundboard 22, and lower layer member 50 are equally applicable to each other, and to the intermediate bracing layer member 58.

In at least one embodiment, the intermediate bracing layer member 58 includes a substantially rectangular section 60 which is disposed proximate to the rectangular section 34 of the lower layer member 50, which in turn is located proximate to the portion of the soundboard 22 constructed to engage the neck of a stringed instrument. In some embodiments, the intermediate bracing layer member 58 includes elongate sides 62 which are substantially linear, and which are disposed centrally relative to the transitions 54. In some embodiments, the elongate sides 62 are not required to be linear and may be curved, or another shape, to accomplish a desired level of structural or acoustic performance.

In at least one embodiment, the elongate sides 62 are a mirror image relative to each other across the bisecting medial line 38. In some embodiments, the elongate sides 62 diverge outwardly relative to each other for a desired distance towards the bottom of the soundboard 22. In at least one embodiment at an approximate distance of 70% away from the rectangular section 60 of the intermediate bracing layer member 58, the elongate sides 62 intersect with converging side portions 64 which terminate at a point 66 which is positioned proximate to the tip or point of the fifth point portion 52 of the lower layer member 50. In some embodiments the approximate length of the elongate sides 62 may vary, and be greater or less than 70% of the distance away from the rectangular section 60.

In certain embodiments, the intermediate bracing layer member 58 is disposed or stacked upon the central section 42 of the lower layer member 50 enhancing the structural integrity of the soundboard 22 along the longitudinal axis of the stringed instrument below the strings.

In an alternative embodiment, the intermediate bracing layer member 58 includes one or more honeycomb or shaped cores 16, and corresponding top layers 12, bottom layers 14, side layers 18, and intermediate layers 20.

In some embodiments, an upper bracing layer member 68 is stacked upon and is centrally disposed relative to the intermediate bracing layer member 58. The upper bracing layer member 68 may be shaped substantially similar to the intermediate bracing layer member 58 including a rectangular section 70, elongate sides 72, and converging side portions 70 for terminating in a point 76. The features, functions, and elements as described relative to the lower layer member 50 and intermediate bracing layer member 58 are equally applicable to the upper bracing layer member 68 herein.

In at least one embodiment, a honeycomb or shaped core 16 may be used with the lower layer member 50, intermediate bracing layer member 58, and upper bracing layer member 68 or any combination thereof. In some embodiments a honeycomb or shaped core 16 is not used in any of the lower layer member 50, intermediate bracing layer member 58, and upper bracing layer member 68.

In certain embodiments in which a honeycomb or shaped core 16 is used, then the sides of the honeycomb or shaped core 16 may be open or closed through the use of side layers 18. In certain embodiments in which a honeycomb or shaped core 16 is used, then the direction of the cells may be aligned vertically or horizontally relative to the sides of the lower layer member 50, intermediate bracing layer member 58 and upper bracing layer member 68. In certain embodiments, the direction of the cells between adjacent or separated layers of honeycomb or shaped core 16 may be substantially identical or juxtaposed or in any combination relative to each other. For example, in some embodiments the direction of the cells of the honeycomb or shaped core 16 may be aligned and/or substantially identical for all of the layers of honeycomb or shaped core 16. In other embodiments, in every adjacent layer, or every other layer of honeycomb or shaped core 16, the cells may be juxtaposed from either a vertical or horizontal direction relative to another layer of honeycomb or shaped core 16. In other embodiments, any combination or pattern for the alignment of cells of the honeycomb or shaped core 16 may occur to provide a desired structural integrity and/or acoustical resonance property for the soundboard 22.

In certain embodiments, any number of lower layer members 50, intermediate bracing layer members 58 and/or upper bracing layer members 68 may be used with a soundboard 22. In some embodiments, each of the lower layer members 50, intermediate bracing layer members 58 and/or upper bracing layer members 68 may include one or more honeycomb or shaped cores 16, and corresponding top layers 12, bottom layers 14, intermediate layers 20 and/or side layers 18.

In at least one embodiment, the number of top layers 12 and/or bottom layers 14 may be increased or decreased between each layer of honeycomb or shaped core 16. In other embodiments, the number of side layers 18 used in association with the lower layer member 50, intermediate bracing layer member 58, and/or upper bracing layer member 68 may be increased and/or decreased to provide a desired property for the laminate faced honeycomb or other shaped bracing 10.

In at least one embodiment, the laminate faced honeycomb or other shaped bracing 10, lower layer member 50, intermediate bracing layer member 58 and/or upper bracing layer member 68 may be related to U.S. Pat. No. 8,450,587 which is incorporated by reference herein in its entirety. In some embodiments the laminate faced honeycomb or other shaped bracing 10, lower layer member 50, intermediate bracing layer member 58, and/or upper bracing layer member 68 may be attached to or integral with a sheet structure or partial sheet structure for engagement to a soundboard 22.

In some embodiments, the laminate faced honeycomb or other shaped bracing 10, intermediate bracing layer member 58 and/or upper bracing layer member 68 may initially be fabricated, molded, or manufactured to provide an adjustable or variable stiffness to the soundboard 22. The stiffness for a soundboard 22 may be varied or adjusted by the initial selection or designation of the materials to be utilized for the top layer 12, bottom layer 14, honeycomb core 16 or 26, intermediate layer 20 and/or side layers 18. The stiffness for a soundboard 22 may also be varied or adjusted by the number of top layers 12, bottom layers 14, honeycomb or shaped cores 16 or 26, intermediate layers 20 and/or side layers 18 utilized. Further, the stiffness for a soundboard 22 may be varied or adjusted by the size, number, and/or orientation of the cells within the honeycomb or shaped cores 16 or 26, to provide a desired tonal acoustic quality for the stringed instrument. In some embodiments, thicker walled honeycomb or shaped cores 16 or 26 may be utilized, which in turn enables the use of an increased size of cell or void within the honeycomb or shaped cores 16 or 26.

In some embodiments, the thickness, size and shape of the cells within the honeycomb or shaped cores 16 or 26 may be altered to be octagonal, pentagonal, oval, circular, square, rectangular, or any other desired shape to provide an acoustic or tonal quality for the stringed instrument. In some embodiments, the cells may be open or closed.

In some embodiments, a laminate faced honeycomb or other shaped brace 10, lower layer member 50, intermediate bracing layer member 58, soundboard 22, and/or upper bracing layer member 68 may include one or more sidewalls 18 which function as a thick exterior outer rim for the sound board 22.

In certain embodiments the laminate faced honeycomb or other shaped brace 10, lower layer member 50, intermediate bracing layer member 58, and/or upper bracing layer member 68 selectively reinforce the soundboard 22 in certain locations, to provide a desired vibration for tone or acoustic properties and string tension, to maintain the structural integrity for the stringed instrument.

In some embodiments, a soundboard 22 including a laminate faced honeycomb or other shaped brace 10, lower layer member 50, intermediate bracing layer member 58, or upper bracing layer member 68 may have a bending stiffness ratio of approximately 1 to 1. In other embodiments, the bending stiffness ratio may be greater or less than 1 to 1 as desired for a particular stringed instrument. In certain embodiments, the laminate faced honeycomb or other shaped brace 10, lower layer member 50, intermediate bracing layer member 58, upper bracing layer member 68, are used to facilitate the structural integrity of a soundboard 22 exposed to string tension and to simultaneously shape the tonal acoustic and vibrational properties to provide a desired natural warm sound for the stringed instrument.

In some embodiments, the laminate faced honeycomb or other shaped bracing 10, lower layer member 50, intermediate bracing layer member 58, and/or upper bracing layer member 68 cover approximately 50% of the central surface area of a soundboard 22 for a stringed instrument, leaving certain areas proximate to the perimeter 44 for the soundboard 22 thin and un-braced. In other embodiments the laminate faced honeycomb or other shaped brace 10, lower layer member 50, intermediate bracing layer member 58 and/or upper bracing layer member 68 may cover more or less than approximately 50% of the surface area of the soundboard 22 depending upon the desired structural integrity and acoustic properties for the stringed instrument.

In some embodiments, the shape and size of the lower layer member 50, intermediate bracing layer member 58, and/or upper bracing layer member 68 may be altered in design to provide a shape configuration to optimize a desired tonal response and that the embodiments identified herein have been provided for illustrative purposes and are not intended to be limiting with respect to any particular desired shape.

In certain embodiments, additional sections or layers of carbon fiber or fibrous laminate, material and/or portions of laminate faced honeycomb or other shaped material, may be added to localized regions of a soundboard 22, which are specifically designed to reduce the adverse structural effects of string tension.

In at least one embodiment, the lower layer member 50 has the largest surface area for the laminate faced bracing structure 10 and covers approximately 20% to 50% of the surface of the soundboard 22. In other embodiments, the dimensions of the lower layer member 50 may be adjusted to cover less than 20% or more than 50% of the surface area of the soundboard 22. In some embodiments, the lower layer member 50 includes generally triangular shaped ribs protruding from a center portion or section 42.

In another embodiment the intermediate bracing layer member 58 having a honeycomb or shaped core 16 is added to the top of the lower layer member 50 to minimize local deflection. In some embodiments, the overall bracing structure may also have any combination of orientations for the honeycomb or shaped core 16, and one or more of the honeycomb or shaped cores 16 may have different shaped or sized cells. The embodiments identified herein are provided for illustrative purposes only and are not intended to be limiting as to the number of different types of orientations or configurations for the honeycomb or shaped core 16 and cells within a laminate faced honeycomb or other shaped bracing structure 10 as disclosed herein.

In one embodiment, FIG. 1 shows a soundboard 22 formed of a single layer 24. The soundboard 22 and laminate faced honeycomb or other shaped bracing structure 10 are preferably integral to each other. In at least one embodiment, the soundboard 22 and laminate faced honeycomb or other shaped bracing structure 10 have been formed of consecutive layers of material bonded together which have been cut as a unitary structure.

Figure 2:
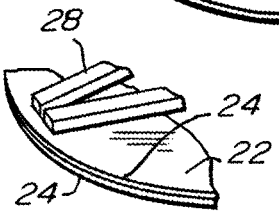
FIG. 2 is a partial detailed view of one embodiment of a soundboard having multiple carbon fiber or other fibrous laminate layers.

In at least one embodiment as identified in FIG. 2, the soundboard 22 has been formed of two individual layers of material 24 as previously identified herein.

Figure 3:
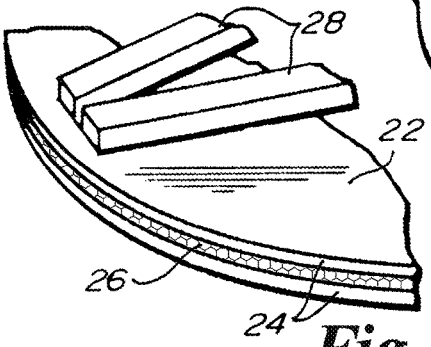
FIG. 3 is an alternative partial detailed view of one embodiment of a soundboard having multiple carbon fiber or other fibrous laminate layers.

In at least one embodiment as depicted in FIG. 3, the soundboard 22 is formed of a honeycomb or shaped core 26 and an individual layer of material 24 on each side of the honeycomb or shaped core 26.

Figure 4:
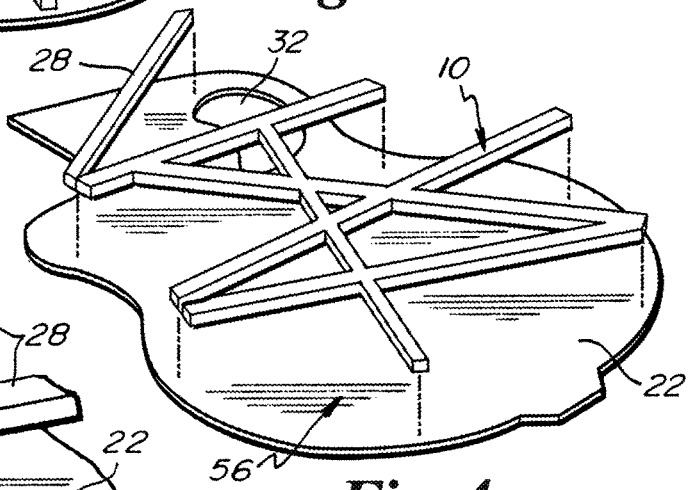
FIG. 4 is an alternative isometric view of one embodiment of a laminate faced honeycomb or other shaped bracing structure for engagement to a soundboard according to the invention.

In some embodiments as identified in FIG. 4, a laminate faced honeycomb or other shaped bracing structure 10 is engaged to a soundboard 22. In at least one embodiment the soundboard 22 has been formed separately from the laminate faced honeycomb or other shaped bracing structure 10, where the laminate faced honeycomb or other shaped bracing structure 10 has been disposed upon and attached or bonded to the soundboard 22.

Figure 5:
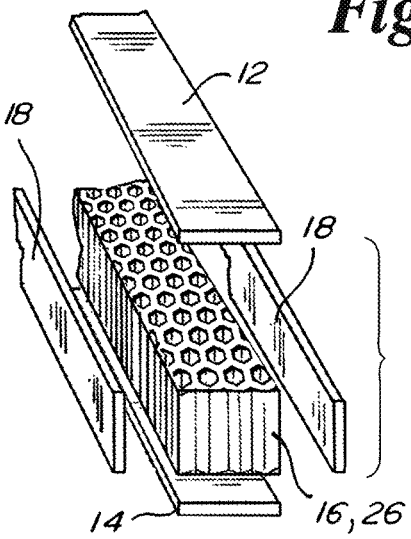
FIG. 5 is a partial detailed view of one embodiment of a honeycomb or other shaped core of one embodiment of a laminate faced honeycomb bracing structure.

At least one alternative embodiment as depicted in FIG. 5, a honeycomb or shaped core 16, 26 is disposed with the internal cells oriented in a vertical direction. The honeycomb or shaped core 16, 26 is enclosed within a top layer 12, a bottom layer 14, and a pair of opposite side layers 18.

Figure 6:
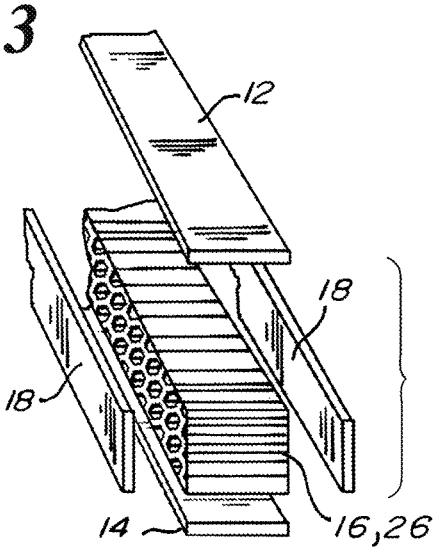
FIG. 6 is an alternative partial detail view of one embodiment of a honeycomb or other shaped core of one embodiment of a laminate faced honeycomb or other shaped bracing structure.

In contrast, in an alternative embodiment as depicted in FIG. 6, a honeycomb or shaped core 16, 26 is disposed with the internal cells oriented in a horizontal direction. The honeycomb or shaped core 16, 26 is enclosed within a top layer 12, a bottom layer 14, and a pair of opposite side layers 18.

Figure 7:
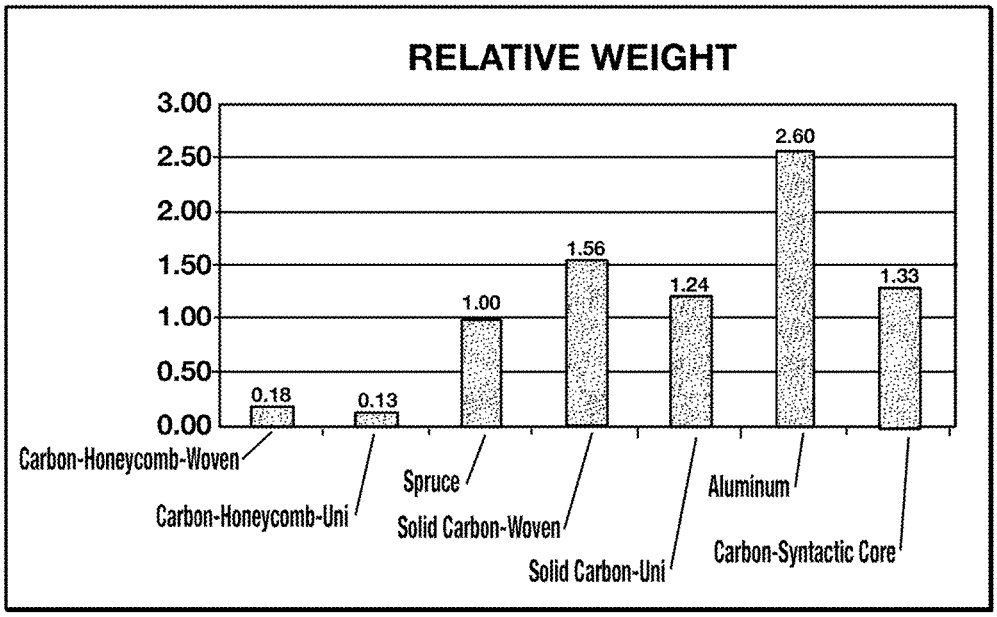
FIG. 7 is a graph related to relative weights and bending stiffness of materials utilized in bracing structures for stringed musical instruments.

FIG. 7 shows the structural efficiency of the invention. FIG. 7 shows a graph comparison of the weight of several materials of equivalent bending stiffness. FIG. 7, shows that carbon fiber faced honeycomb is less than 20% of the weight of spruce bracing, and less than 15% of a solid carbon laminate. The weight of bracing is an important factor in soundboards because mass may impede vibration of the soundboard. Generally, the higher the mass of the soundboard (assuming constant stiffness), the lower the amplitude of vibration from a given string input. The lower the amplitude of vibration produced by the soundboard, the lower the volume of the instrument. Also, mass in the soundboard reduces sustain; for a higher mass, more energy is dissipated in every vibration cycle, and the string energy, soundboard vibration, and volume decrease faster resulting in less sustain.

The above relationships are very complex, and a low mass, high stiffness soundboard will not necessarily create a desirable acoustic response—however, the high stiffness for a given weight makes the carbon fiber faced honeycomb generally a superior brace material.

The other benefit of the laminate faced honeycomb or other shaped brace material is that it effectively damps the excess upper mid and upper frequencies that carbon fiber soundboards tend to produce—these frequencies can provide a harsh tone, especially at higher volume levels.

Figure 8:
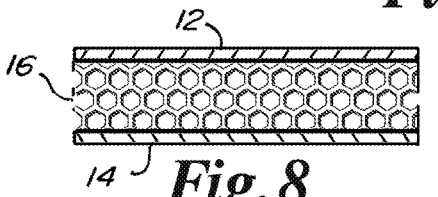
FIG. 8 is a partial detailed cross-sectional side view taken along the line 8-8 of FIG. 13, of one embodiment of a laminate faced honeycomb or other shaped bracing structure according to the invention.

FIG. 8 depicts a cross-sectional detail side view of one embodiment of the elongate multi-pointed concave polygon shaped 30 bracing structure. As depicted in FIG. 8 a honeycomb or shaped core 16 is faced by a top layer 12 and a bottom layer 14.

Figure 9:
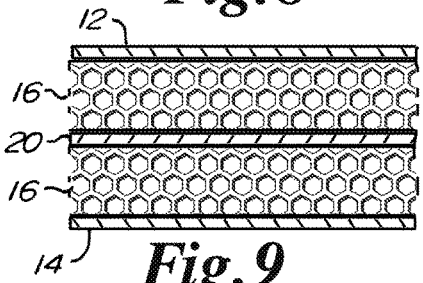
FIG. 9 is an alternative partial detailed cross-sectional side view taken along the line 8-8 of FIG. 13, of one embodiment of a laminate faced honeycomb or other shaped bracing structure according to the invention.

FIG. 9 depicts a cross-sectional detail side view of an alternative embodiment of the elongate multi-pointed concave polygon shaped 30 bracing structure. In FIG. 9 the shaped bracing structure 30 is formed of a bottom layer 14, a first honeycomb or shaped layer 16, and intermediate layer 20, a second honeycomb or shaped core 16, and a top layer 12. It should be noted that the individual layers of honeycomb or shaped core 16 are stacked relative to one another to provide a desired structural integrity and bracing for a soundboard 22, as well as providing a desired vibration and acoustic property for a stringed instrument.

Figure 10:
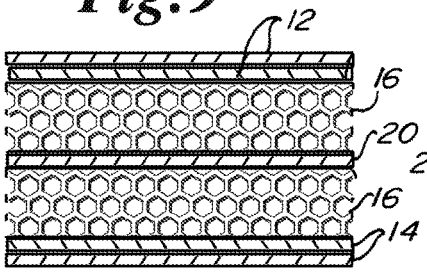
FIG. 10 is an alternative partial detailed cross-sectional side view taken along the line 8-8 of FIG. 13, of one embodiment of a laminate faced honeycomb or other shaped bracing structure according to the invention.

FIG. 10 depicts a cross-sectional detail side view of an alternative embodiment of the elongate multi-pointed concave polygon shaped bracing structure 30. In FIG. 10 the shaped bracing structure 30 is formed of two bottom layers 14, a first honeycomb or shaped core 16, one intermediate layer 20, a second honeycomb or shaped core 16, and two top layers 12. In at least one embodiment the number of top layers 12, intermediate layers 20, and bottom layers 14 may vary, and any number of individual layers may be used in combination above, below, or in between any number of layers of honeycomb or shaped core 16.

Figure 11:
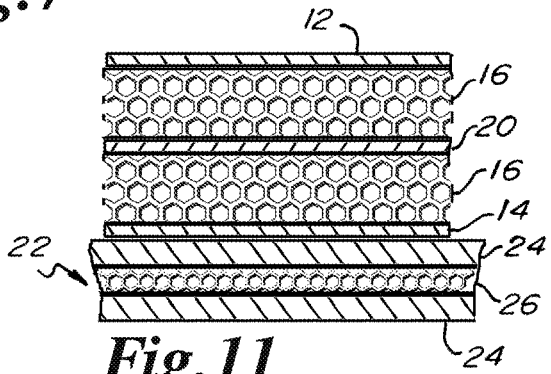
FIG. 11 is an alternative partial detailed cross-sectional side view taken along the line 8-8 of FIG. 13, of one embodiment of a soundboard having a laminate faced honeycomb or other shaped bracing structure according to the invention.

FIG. 11 depicts a cross-sectional detail side view of an alternative embodiment of the elongate multi-pointed concave polygon shaped bracing structure 30 as engaged to a soundboard 22. FIG. 11 depicts a soundboard 22 which is formed of individual layers 24 above and below a honeycomb or shaped core 26. Disposed immediately above an individual layer 24 is a bottom layer 14 of the bracing structure 10. Immediately adjacent to the bottom layer 14 is a first layer of honeycomb or shaped core 16. On top of the first layer of honeycomb or shaped core 16 is positioned an intermediate layer 20. A second layer of honeycomb or shaped core 16 is disposed on top of the intermediate layer 20, and a top layer 12 is disposed on the second layer of honeycomb or shaped core 16. It should be noted that any desired number of layers of honeycomb or shaped core 16 may be used in association with the shaped bracing structure 30. It should also be noted that any desired number of individual layers 24 and/or layers of honeycomb or shaped core 26 may be used to form the soundboard 22.

Figure 12:
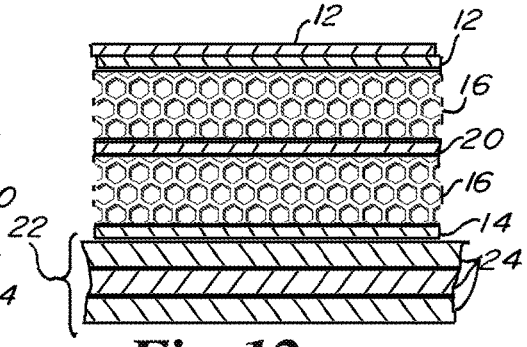
FIG. 12 is an alternative partial detailed cross-sectional side view taken along the line 8-8 of FIG. 13, of one embodiment of a soundboard having a laminate faced honeycomb or other shaped bracing structure according to the invention.

FIG. 12 depicts a cross-sectional detail side view of an alternative embodiment of the elongate multi-pointed concave polygon shaped bracing structure 30 as engaged to a soundboard 22. In FIG. 12 the soundboard 22 is formed of three individual layers 24. On top of the uppermost individual layer 24 is located a bottom layer 14. A first layer of honeycomb or shaped core 16 is disposed on top of the bottom layer 14. An intermediate layer 20 is disposed on top of the first layer of honeycomb or shaped core 16. A second layer of honeycomb or shaped core 16 is disposed on top of the intermediate layer 20. Two top layers 12 are disposed above the second layer of honeycomb or shaped core 16.

FIG. 13 depicts a top view an alternative embodiment of the elongate multi-pointed concave polygon shaped bracing structure 30 as engaged to a soundboard 22. In FIG. 13 a lower layer member 50 is disposed on top of the soundboard 22. An intermediate bracing layer member 58 is disposed on top of the lower layer member 50, and an upper bracing layer member 68 is disposed on the intermediate bracing layer member 58.

Figure 14:
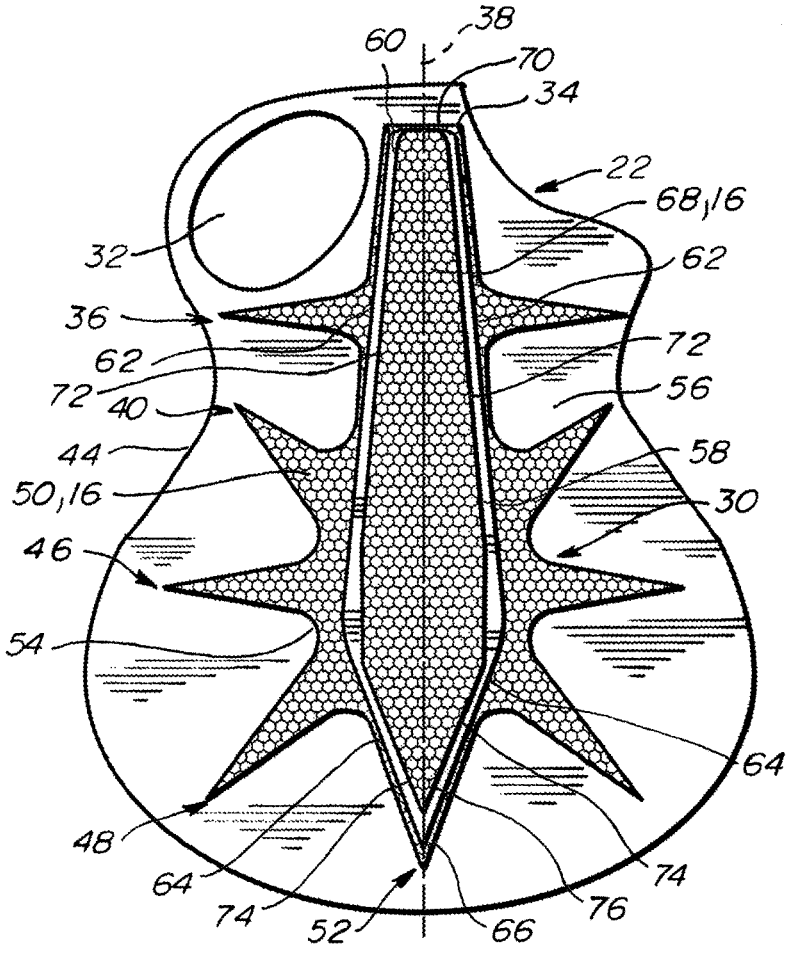
FIG. 14 is an alternative top view of one embodiment of a soundboard having a laminate faced honeycomb or other shaped bracing structure according to the invention where the top layer of carbon fiber or fibrous laminate material has been removed from the lower layer member of the laminate faced honeycomb or other shaped bracing structure and the top layer of carbon fiber or fibrous laminate material has been removed from the upper bracing layer member of the laminate faced honeycomb or other shaped bracing structure.

In an alternative embodiment as depicted in FIG. 14, the top layer 12, which in certain embodiments is disposed on the honeycomb or shaped core 16 of the lower layer member 50, has been removed as well as the top layer 12 of the upper bracing layer member 68, exposing the honeycomb or shaped core 16. It should be noted that in certain embodiments that a top layer 12, bottom layer 14, and/or side layers 18 are not required if the cells for the honeycomb or shaped core 16 are to be exposed in order to enhance vibration and/or acoustic performance for a soundboard 22.

Figure 15:
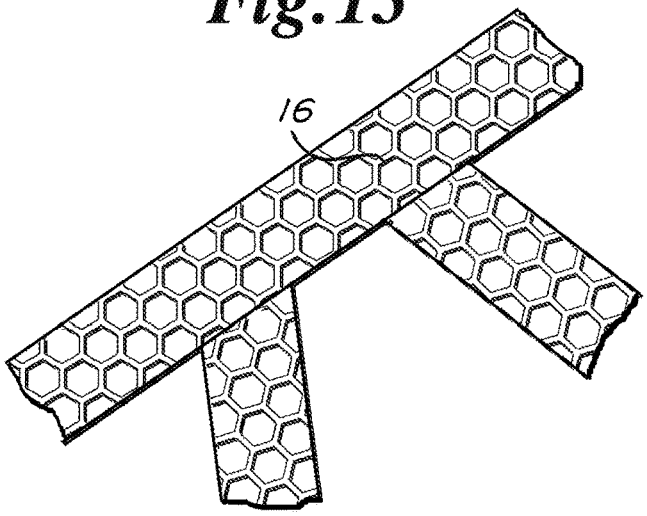
FIG. 15 is a detail view of one embodiment of a honeycomb or shaped core of a laminate faced honeycomb or other shaped bracing structure according to the invention.

FIG. 15 shows a laminate faced honeycomb or other shaped bracing structure 10 where the portions of the bracing structure are independently manufactured and are affixed or bonded together to form the bracing structure.

Figure 16:
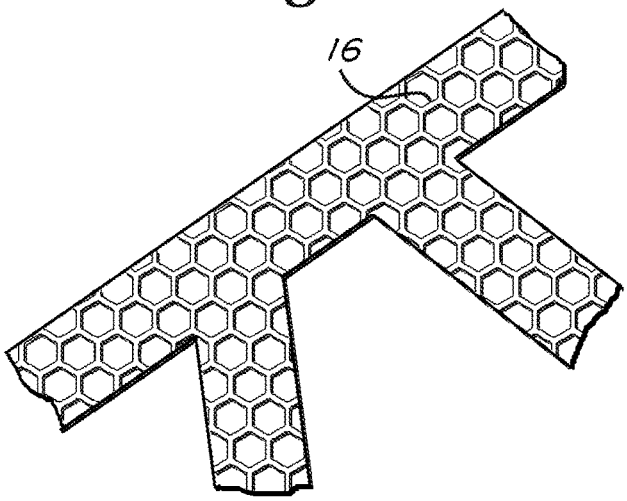
FIG. 16 is a detail view of one alternative embodiment of a honeycomb or shaped core of a laminate faced honeycomb or other shaped bracing structure according to the invention.

FIG. 16 shows a laminate faced honeycomb or other shaped bracing structure 10 where the portions of the bracing structure are manufactured as a single component and are cut into a desired shape for use with a soundboard 22.

Figure 17:
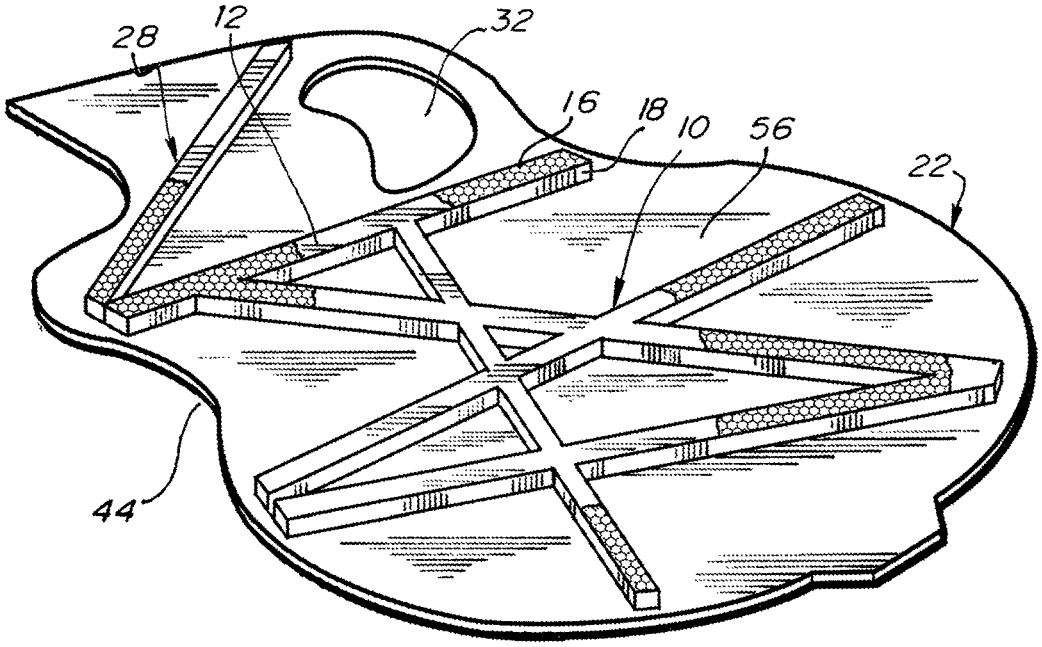
FIG. 17 is an alternative isometric partial cut away view of one embodiment of a laminate faced honeycomb or other shaped bracing structure and soundboard according to the invention.

FIG. 17 shows a soundboard 22 having a laminate faced honeycomb or other shaped bracing structure 10 engaged thereto. In an alternative embodiment, portions of the top layer 12 as disposed on the honeycomb or shaped core 16 may be omitted to partially expose the cells of the honeycomb or shaped core 16. It should be noted that individual portions of the honeycomb or shaped core 16 or 26, may be exposed to enhance the performance characteristics for the soundboard 22. It should also be noted that selected portions of the cells of a honeycomb or shaped core 16, as is utilized in either the lower layer member 50, the intermediate bracing layer member 58, and/or the upper bracing layer member 68, may be exposed to enhance the performance characteristics of the soundboard 22.

Figure 18:
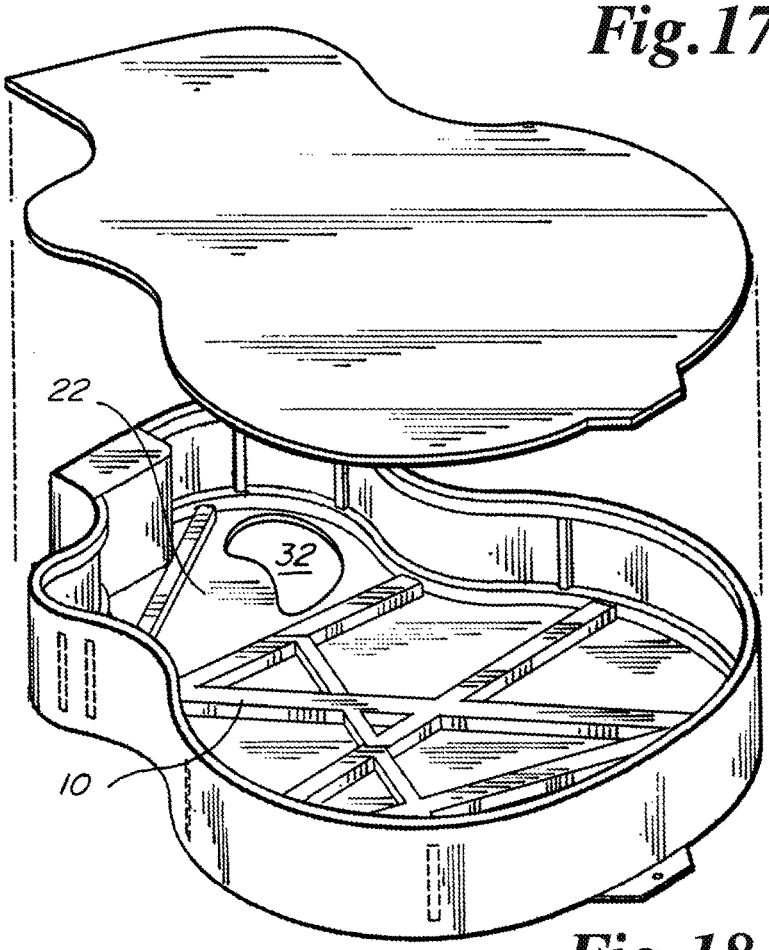
FIG. 18 is an alternative isometric view of one embodiment of a laminate faced honeycomb or other shaped bracing structure and soundboard engaged to a sound box of a stringed instrument.

FIG. 18 depicts a sound box for a stringed instrument including a soundboard 22, side wall and back.

The laminate faced honeycomb or other shaped bracing structure 10, the lower layer member 50, the intermediate bracing layer member 58, the upper bracing layer member 68 and/or the soundboard 22 may be utilized and/or combined with any feature or element described in U.S. Pat. No. 8,450,587, the entire contents of which being incorporated by reference herein in its entirety.

In some embodiments, the thickness dimension for any of the top layers 12, bottom layers 14, side layers 18 and/or intermediate layers 20 may be identical to each other, different relative to one another, or vary relative to each other at any location relative to a soundboard 22.

In some embodiments, the width, height, depth, thickness, and/or shape of the individual top layers 12, bottom layers 14, side layers 18, and/or intermediate layers 20 may gradually or dramatically change by increasing or decreasing dimensions, along the length of the bracing structure or at certain desired locations, in order to provide the desired sound quality or tone effect for the soundboard 22.

Structural honeycomb has been used in aircraft sandwich laminates, and its use has continued to grow in to a multitude of high performance and structural applications where light weight structures are desired. Honeycomb structures perform well in situations where the structure experiences bending loads. In these applications, the material near the surface carries most of the stress and provides most of the resistance to bending, while the material nearer the center of the thickness carries much lower shear loads. The concept of using honeycomb is to put the stronger, heavier materials at the surface where they will be most effective, while keeping the center of the structure as light as possible. Typical honeycomb material weighs on the order of 2 to 5 lb/ft3 whereas aluminum, for example, weighs 169 lb/ft3, thus the use of honeycomb core may conserve weight. A typical honeycomb configuration weighs less than 10% of a solid metal configuration.

Traditional honeycomb is fabricated by taking sheets of thin material, such as aluminum, resin impregnated Nomex paper, fiberglass laminates, etc, and bonding them together in alternating strips. These sheets are then expanded, and the un-bonded areas fold out, and a typically hexagonal honeycomb structure is formed. The resulting structure is very light, because the majority of the volume is air, and also has high shear stiffness in the direction perpendicular to the thickness direction, which makes it an ideal material for a structural honeycomb. The most common materials used in honeycomb are resin impregnated aramid fiber paper (Nomex), and aluminum, but fiberglass, carbon fiber, fibrous laminate material, stainless steel, Kraft paper, polyethylene, polypropylene, and many other materials are used to make honeycomb materials. In the case of plastic honeycombs, the core may be molded into shape rather than expanded. The shape of the cells is typically hexagonal, but other core cell shapes have been used as well.

In one embodiment, a stringed instrument comprising, a sound box defining an inner space is provided. The sound box comprises a bottom board, a soundboard and a side wall, the bottom board, soundboard and side wall each having an inner surface which faces the inner space, the side wall being between the bottom board and the soundboard, wherein the bottom board and the soundboard each have a periphery, and the side wall has an upper periphery and a lower periphery, the periphery of the soundboard being connected to the upper periphery and the periphery of the bottom board being connected to the lower periphery. In at least one embodiment, the soundboard comprises a sound hole.

In a first embodiment, a stringed musical instrument is disclosed, the stringed instrument comprising:

a. A plurality of musical strings, each of which has a vibration section for defining a musical tone;
b. A soundboard positioned to interact with the string vibration sections to enhance musical tones produced by vibration of said string sections, the soundboard being made of a plurality of composite material laminates primarily comprised of carbon fiber, fibrous laminate material and resin or plastic matrix; and
c. Bracing attached to the soundboard for the purpose of reacting string tension and/or shaping musical response, with the said bracing being comprised of one or more thin sheets of carbon laminate bonded to one or more layers honeycomb or shaped core.

In an alternative second embodiment, the bracing is made by cutting and stacking layers of sandwich construction comprised of one ply of fibrous laminate on either side of a layer of honeycomb or shaped core.

In an alternative third embodiment, the soundboard and bracing are all fabricated at the same time by layering the layers of the carbon fiber soundboard, and the carbon fiber or fibrous laminate and honeycomb layers of the brace, into a single laminate and curing together.

In an alternative fourth embodiment, the soundboard and reinforcing bracing are made separately in sheets, then cut and bonded together.

In an alternative fifth embodiment, the bracing is made by shaping first the honeycomb or shaped core to the desired thickness and shape, and bonding one or more layers of a carbon fiber or fibrous laminate to the honeycomb or shaped core.

In an alternative sixth embodiment, the soundboard and bracing are all fabricated at the same time by layering the layers of the carbon fiber soundboard, and the carbon fiber or fibrous laminates and honeycomb layers of the brace, into a single laminate and curing the elements together.

In an alternative seventh embodiment, the soundboard and reinforcing bracing are made separately and are then bonded together.

In an alternative eight embodiment, the shape and positioning of the honeycomb braces is primarily to react string tension and stabilize the soundboard.

In an alternative ninth embodiment, the shape and positioning of the honeycomb or other shaped braces is primarily to shape the tone and acoustic response of the soundboard.

In an alternative tenth embodiment, the shape and positioning of the honeycomb braces is used both to react string tension and to shape the tone and acoustic response of the soundboard.

In an alternative eleventh embodiment, the honeycomb is made of Nomex fiber in a resin matrix, glass fiber in a resin matrix, paper in a resin matrix, carbon fiber in a resin matrix, metals such as aluminum, polymers such as polypropylene, polyvinyl chloride, or similar material.

In some embodiments the laminate faced honeycomb or other shaped bracing structure uses very lightweight honeycomb or shaped core faced with carbon fiber or fibrous laminates to brace carbon fiber soundboards. This combination has been shown to provide both outstanding volume and tonal response when used with a solid carbon fiber soundboard. This combination has been shown to produce superior results to all other types of bracing for carbon fiber or other soundboards. The superior performance may be based on two characteristics (a) the high structural efficiency—that is stiffness for a given weight, and (b) the ability to effectively shape the tonal response.

In some embodiments, the laminate faced honeycomb or other shaped brace 10 is adaptable to traditional as well as non-traditional bracing patterns. In some embodiments, the laminate faced honeycomb or other shaped bracing 10 may be cut in a single piece or constructed from multiple pieces. Additional layers or thickness may be added in areas of high stress to add stiffness and strength.

Each honeycomb or shaped core 16, laminate faced honeycomb or other shaped bracing structure 10, soundboard 22, lower layer member 50, intermediate bracing layer member 58, and upper bracing layer member 68 may be integral or affixed to each other by bonding. Alternatively, each honeycomb or shaped core 16, laminate faced honeycomb or other shaped bracing structure 10, soundboard 22, lower layer member 50, intermediate bracing layer member 58, and upper bracing layer member 68 may be formed by cutting, stacking, and bonding of individual layers of material together to form the soundboard 22, and bracing structure. In some embodiments, layers of honeycomb or shaped core 16, 26 are sandwiched between layers of material as identified herein.

In some embodiments, the layers of honeycomb or shaped core 16 may be formed by molding, autoclaving, vacuum formation, vacuum-bagging, vacuum infusion and other techniques.

In some embodiments, the bracing structure may incorporate a partial or full sized sheet structure engaged to a soundboard. In other embodiments the bracing structure will not incorporate a sheet structure. In some embodiments the bracing structure will be formed into a traditional bracing pattern. In other embodiments the bracing structure will be formed into a non-traditional bracing pattern. In at least one embodiment any combination of bracing structures as identified herein may be affixed, engaged, bonded, integral with or otherwise attached to a soundboard 22.

In a twelfth alternative embodiment a soundboard for a musical instrument is provided, said soundboard comprising: at least one layer of material, said at least one layer of material comprising carbon fiber, fibrous laminate material, resin, or a plastic matrix and combinations thereof; and at least one bracing structure engaged to said at least one layer of material, said at least one bracing structure comprising at least one layer of honeycomb or shaped core.

In a thirteenth alternative embodiment according to the twelfth embodiment the at least one layer of honeycomb or shaped core has opposite sides, said at least one bracing structure further comprising at least one sheet of carbon fiber or fibrous laminate material on either of said opposite sides of said at least one layer of honeycomb or shaped core.

In a fourteenth alternative embodiment according to the twelfth embodiment the bracing structure is constructed and arranged to react string tension and stabilize said soundboard.

In a fifteenth alternative embodiment according to the twelfth embodiment the bracing structure is constructed and arranged to shape the tone and acoustic response of said soundboard.

In a sixteenth alternative embodiment according to the twelfth embodiment the bracing structure is constructed and arranged to react string tension and stabilize said soundboard, and to shape the tone and acoustic response of said soundboard.

In a seventeenth alternative embodiment according to the twelfth embodiment the honeycomb or shaped core is formed of material selected from the group consisting of Nomex fiber in a resin matrix, glass fiber in a resin matrix, paper in a resin matrix, carbon fiber in a resin matrix, metals such as aluminum, polymers such as polypropylene, and polyvinyl chloride and combinations thereof.

In an eighteenth alternative embodiment according to the twelfth embodiment the at least one bracing structure comprising at least one lower layer member, wherein said at least one layer of honeycomb or shaped core is engaged to said at least one lower layer member.

In a nineteenth alternative embodiment according to the eighteenth embodiment the at least one lower layer member includes said at least one layer of honeycomb or shaped core.

In a twentieth alternative embodiment according to the eighteenth embodiment the at least one bracing structure further comprising at least one intermediate bracing layer member engaged to said at least one lower layer member.

In a twenty-first alternative embodiment according to the twentieth embodiment the at least one intermediate bracing layer member comprising said at least one layer of honeycomb or shaped core.

In a twenty-second alternative embodiment according to the twentieth embodiment the at least one bracing structure further comprising at least one upper bracing layer member engaged to said at least one intermediate bracing layer member.

In a twenty-third alternative embodiment according to the twenty-second embodiment the at least one upper bracing layer member comprising said at least one layer of honeycomb or shaped core.

In a twenty-fourth alternative embodiment according to the twelfth embodiment the at least one bracing structure comprising at least one lower layer member, at least one intermediate bracing layer member engaged to said at least one lower layer member, and at least one upper bracing layer member engaged to said at least one intermediate bracing layer member.

In a twenty-fifth alternative embodiment according to the twenty-fourth embodiment the at least one lower layer member comprising said at least one layer of honeycomb or shaped core, or said at least one intermediate bracing layer member comprising said at least one layer of honeycomb or shaped core, or said at least one upper bracing layer member comprising said at least one layer of honeycomb or shaped core.

In a twenty-sixth alternative embodiment according to the twenty-fourth embodiment the at least one lower layer member comprising at least one layer of honeycomb or shaped core, and said at least one intermediate bracing layer member comprising at least one layer of honeycomb or shaped core, and said at least one upper bracing layer member comprising at least one layer of honeycomb or shaped core.

In a twenty-seventh alternative embodiment a method for manufacture of a soundboard for a stringed musical instrument is provided, said method comprising: selecting at least one layer of material to form said soundboard, said at least one layer of material comprising carbon fiber, fibrous laminates, resin, or a plastic matrix and combinations thereof; forming at least one bracing structure, said at least one bracing structure comprising at least one layer of honeycomb or shaped core and bonding or engaging said at least one bracing structure to said at least one layer of material.

In a twenty-eighth alternative embodiment according to the twenty-seventh embodiment the at least one bracing structure is formed by cutting and stacking layers comprised of carbon fiber or fibrous laminate on either side of said layer of honeycomb or shaped core.

In a twenty-ninth alternative embodiment according to the twenty-seventh embodiment the at least one bracing structure is fabricated into a unitary structure by layering layers of the carbon fiber or fibrous laminate and honeycomb and curing together.

In a thirtieth alternative embodiment according to the twenty-seventh embodiment the soundboard and said at least one bracing structure are formed separately by cutting of at least one layer of composite material, and at least one layer of honeycomb or shaped core, and bonding said soundboard and said at least one bracing structure together.

In a thirty-first alternative embodiment according to the twenty-seventh embodiment the bracing structure is formed by shaping first the honeycomb or shaped core into a desired shape and a desired thickness and then bonding one or more layers of a carbon fiber or fibrous laminate material to the honeycomb or shaped core.

In a thirty-second alternative embodiment according to the twenty-seventh embodiment the soundboard and said at least one bracing structure are fabricated into a unitary structure by layering layers of composite material, at least one layer of honeycomb or shaped core and at least one sheet of carbon material and curing together.

In a thirty-third alternative embodiment a method is disclosed for manufacture of a soundboard for a stringed musical instrument, said method comprising:

selecting at least one layer of material to form said soundboard, said at least one layer of material comprising fiber laminate;

forming at least one bracing structure, said at least one bracing structure comprising at least one layer of honeycomb or other shaped core; and bonding said at least one bracing structure to said soundboard.

In a thirty-fourth alternative embodiment according to the thirty-third embodiment the method for manufacture of a soundboard wherein said at least one layer of material further comprises resin.

In a thirty-fifth alternative embodiment according to the thirty-third embodiment the method for manufacture of a soundboard wherein said at least one layer of material further comprises at least one plastic matrix.

In a thirty-sixth alternative embodiment according to the thirty-third embodiment the method for manufacture of a soundboard wherein said at least one layer of material further comprises resin or at least one plastic matrix or both resin and at least one plastic matrix.

In a thirty-seventh alternative embodiment according to the thirty-third embodiment the method for manufacture of a soundboard wherein said at least one layer of honeycomb or shaped core has sides and said at least one bracing structure is formed by cutting and stacking layers comprised of fiber laminate on either side of said at least one layer of honeycomb or shaped core.

In a thirty-eighth alternative embodiment according to the thirty-seventh embodiment the method for manufacture of a soundboard wherein said stacked layers of fiber laminate are bonded to said sides of said at least one layer of honeycomb or shaped core.

In a thirty-ninth alternative embodiment according to the thirty-third embodiment the method for manufacture of a soundboard further comprising forming said at least one layer of honeycomb or shaped core by layering layers of carbon fiber laminate material.

In a fortieth alternative embodiment according to the thirty-ninth embodiment the method for manufacture of a soundboard wherein said soundboard and said at least one bracing structure are fabricated into a unitary structure by layering said at least one layer of material and said layers of fiber laminate material.

In a forty-first alternative embodiment according to the thirty-third embodiment the method for manufacture of a soundboard wherein each of said soundboard and said at least one bracing structure are cut separately and are bonded together.

In a forty-second alternative embodiment according to the thirty-third embodiment the method for manufacture of a soundboard further comprising shaping said at least one layer of honeycomb or shaped core and bonding at least one layer to said at least one layer of honeycomb or shaped core.

In addition to being directed to the embodiments described above and claimed below, the present invention is further directed to embodiments having different combinations of the dependent features described above and/or claimed below. Every patent, application or publication mentioned above is herein incorporated by reference.

The invention contemplates any combination of the above described elements of the stringed instrument. Therefore, it should be understood that multiple inventions are disclosed herein.

The above examples and disclosure are intended to be illustrative and not exhaustive. These examples and description will suggest many variations and alternatives to one of ordinary skill in this art. Further, the particular features presented in the dependent claims can be combined with each other in other manners within the scope of the invention such that the invention should be recognized as also specifically directed to other embodiments having any other possible combination of the features of the dependent claims.

This completes the description of the alternate embodiments of the invention. Those skilled in the art may recognize other equivalents to the specific embodiment described herein which equivalents are intended to be encompassed by the claims attached hereto.

The invention claimed is:

1. A combination soundboard and bracing member for a musical instrument, said soundboard comprising:

at least one layer of material forming said soundboard, said soundboard defining a longitudinal axis, said soundboard defining a sound hole, said sound hole offset from said longitudinal axis, said soundboard having a first size dimension; and said bracing member comprising a first surface layer of material, a second surface layer of material and a core located between said first surface layer and said second surface layer, said core comprising a plurality of similarly shaped cells, said bracing member attached to said soundboard, said bracing member having a second size dimension smaller than said first size dimension;

said bracing member further comprising at least one intermediate bracing layer member engaged to said second surface layer, said at least one intermediate bracing layer member shaped differently from said second surface layer.

2. The soundboard and bracing member of claim 1, said core comprising cells having a hexagonal shape.

3. The soundboard and bracing member of claim 1, wherein said first surface layer comprises a fiber laminate.

4. The soundboard and bracing member of claim 1, wherein said core is formed of material selected from the group consisting of Nomex fiber in a resin matrix, glass fiber in a resin matrix, paper in a resin matrix, carbon fiber in a resin matrix, metals, polymers and combinations thereof.

5. The soundboard and bracing member of claim 1, said first surface layer comprising carbon fiber.

6. The soundboard and bracing member of claim 1, said first surface layer comprising a perimeter having a plurality of straight portions and a plurality of curved portions.

7. The soundboard and bracing member of claim 1, said first surface layer comprising a perimeter having a plurality of concave portions.

8. The soundboard and bracing member of claim 1, said at least one intermediate bracing layer member comprising carbon fiber.

9. The soundboard and bracing member of claim 1, said at least one intermediate bracing layer member further comprising a second core, said second core comprising a plurality of similarly shaped cells.

10. The soundboard and bracing member of claim 1, said core comprising a plurality of sidewall portions that define said cells, said sidewall portions oriented orthogonally to said first surface layer.

11. The soundboard and bracing member of claim 1, said first surface layer and said second surface layer having similar shapes.

12. The soundboard and bracing member of claim 1, said at least one layer of material forming said soundboard comprising carbon fiber.

13. The soundboard and bracing member of claim 1, said at least one layer of material forming said soundboard comprising composite material laminate.

14. The soundboard and bracing member of claim 1, said at least one layer of material forming said soundboard comprising resin.

15. The soundboard and bracing member of claim 1, said at least one layer of material forming said soundboard comprising a plastic matrix.

16. The soundboard and bracing member of claim 1, said at least one layer of material forming said soundboard comprising carbon fiber, resin and a plastic matrix.

17. The soundboard and bracing member of claim 1, wherein a longitudinal axis of said bracing member is aligned upon the longitudinal axis of said soundboard.

* * * * *